US006302239B1

(12) United States Patent
Honda

(10) Patent No.: US 6,302,239 B1
(45) Date of Patent: Oct. 16, 2001

(54) ELEVATOR APPARATUS WITH HOISTING MACHINE BENEATH ELEVATOR CAR

(75) Inventor: Takenobu Honda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/446,189

(22) PCT Filed: Jun. 30, 1998

(86) PCT No.: PCT/JP98/02940

§ 371 Date: Dec. 20, 1999

§ 102(e) Date: Dec. 20, 1999

(87) PCT Pub. No.: WO00/00421

PCT Pub. Date: Jan. 6, 2000

(51) Int. Cl.[7] ..... B66B 11/08
(52) U.S. Cl. ..... 187/254; 187/406
(58) Field of Search ..... 187/254, 256, 187/266, 406, 257, 408, 250

(56) References Cited

U.S. PATENT DOCUMENTS

| | | | | |
|---|---|---|---|---|
| 567,158 | * | 9/1896 | Otis | 187/266 |
| 5,351,788 | * | 10/1994 | DeJong | 187/264 |
| 5,379,863 | * | 1/1995 | Sugawara et al. | 187/233 |
| 5,469,937 | * | 11/1995 | Hakala et al. | 187/266 |
| 5,878,847 | * | 3/1999 | Mustalahti et al. | 187/406 |
| 5,899,300 | * | 5/1999 | Miller et al. | 187/256 |
| 5,899,301 | * | 5/1999 | Aulanko et al. | 187/254 |
| 5,906,251 | * | 5/1999 | Aulanko et al. | 187/254 |

FOREIGN PATENT DOCUMENTS

| | | |
|---|---|---|
| 59-97982 | 6/1984 | (JP) . |
| 6152679 | 4/1986 | (JP) . |
| 6211894 | 3/1987 | (JP) . |
| 63-169581 | 11/1988 | (JP) . |
| 64-69489 | 3/1989 | (JP) . |
| 1-261189 | 10/1989 | (JP) . |
| 9-156855 | 6/1997 | (JP) . |
| 9-165163 | 6/1997 | (JP) . |
| 9-165172 | 6/1997 | (JP) . |
| 9165172 | 6/1997 | (JP) . |
| 10-8755 | 1/1998 | (JP) . |
| 309016 A | 5/1995 | (TW) . |

* cited by examiner

*Primary Examiner*—Jonathan Salata
(74) *Attorney, Agent, or Firm*—Leydig, Voit & Mayer, Ltd.

(57) ABSTRACT

In an elevator apparatus, a hoisting machine having a drum is disposed on a bottom portion of a hoistway. The hoisting machine is within a car projection region obtained by a projection of the car along the hoistway and a portion of the drum is disposed outside the car projection region. A return pulley around which a hoisting rope is wound is disposed between the car projection region and the hoistway wall with a rotary shaft perpendicular to the hoistway wall. At least a portion of the return pulley is located at a height between the hoistway wall and the car when the car is at an uppermost position.

18 Claims, 9 Drawing Sheets

ELEVATOR APPARATUS WITH HOISTING MACHINE BENEATH ELEVATOR CAR

TECHNICAL FIELD

The present invention relates to an elevator apparatus in which a hoisting machine is installed within a hoistway.

BACKGROUND ART

FIG. 8 is a structural view showing a conventional elevator apparatus shown in Japanese Utility Model Application Laid-Open No. Sho 61-52679. FIG. 9 is a plan view of FIG. 8. In these drawings, a machine room 1 is located adjacent to a hoistway 2. A hoisting machine 4 having a drum 3 is installed in the machine room 1. A rotatable return pulley 5 is provided on a ceiling portion of the hoistway 2.

A proximal end portion of a hoisting rope 6 is wound around the drum 3. An intermediate portion of the hoisting rope 6 is wound around the return pulley 5. A car 7 which ascends or descends within the hoistway 2 is suspended at a distal end portion of the hoisting rope 6.

In such an elevator apparatus, the drum 3 of the hoisting machine 4 is rotated so that the hoisting rope 6 is paid out or wound up, thus raising or lowering the car 7 within the hoistway 2.

However, since the machine room 1 is provided for installing the hoisting machine 4, the area in a building occupied by the elevator apparatus increases, and the space utilization efficiency of the building is degraded. Also, since the return pulley 5 is disposed on the ceiling portion of the hoistway 2, it is necessary to keep a space at a top portion of the hoistway 2 for the return pulley 5 in addition to the hoistway stroke of the car 7. This also degrades the utilization efficiency of the building.

Japanese Utility Model Application Laid-Open No. 62-11894 also shows an elevator apparatus in which a machine room is provided in a lower-portion of a staircase adjacent to a hoistway and a hoisting machine is installed in this machine room. However, even in this apparatus, the utilization efficiency of the building is reduced because it is necessary to provide the machine room independent from the hoistway.

Furthermore, Japanese Patent Application Laid-Open No. Hei 9-165172 discloses an elevator apparatus in which a driver for a traction sheave is installed on a wall of a hoistway. However, in this elevator apparatus, it is necessary to make the driver relatively thin so that the traction sheave does not interfere with the car. As a result, there is a fear that sufficient driving force can not be obtained, and that the cost therefore would be increased as well. Also, in order to install the type of hoisting machine generally used, it is necessary to increase the area of the hoistway, which also degrades the utilization efficiency of the building.

DISCLOSURE OF THE INVENTION

In order to solve the above mentioned problems, an object of the present invention is to provide an elevator apparatus for reducing an installation space of the apparatus as a whole to enhance building utilization efficiency while dispensing with a machine room.

In order to attain these and other objects, according to the present invention, there is provided an elevator apparatus comprising: a hoistway having a hoistway wall and a bottom portion; a car which ascends and descends within the hoistway; a hoisting machine having a rotatable drum, the hoisting machine being disposed on the bottom portion of the hoistway so that the hoisting machine is shadowed by a car projection region obtained by a projection from the car in the hoistway direction, with a portion of the drum being out from under the car projection region; a rotatable return pulley disposed within the hoistway; and a hoisting rope having a first end portion connected to the car, a second end portion wound around the drum and an intermediate portion wound around the return pulley through a space between the car and the hoistway wall.

Also, according to another aspect of the present invention, there is provided an elevator apparatus comprising: a hoistway having a hoistway wall and a bottom portion; a car and a balance weight for alternately ascending and descending within the hoistway; a hoisting machine having a rotatable traction sheave, the hoisting machine being disposed on the bottom portion of the hoistway so that the hoisting machine is shadowed by a car projection region obtained by a projection from the car in the hoistway direction, with the traction sheave being out from under the car projection region; first and second rotatable return pulleys disposed within the hoistway; and a rope having a car suspension portion wound around the first return pulley for suspending the first car, a weight suspension portion wound around the second return pulley for suspending the balance weight, and an intermediate portion wound around the traction sheave between the car suspension portion and the weight suspension portion.

BEST MODE FOR CARRYING OUT THE INVENTION

A preferred embodiment of the present invention will now be described with reference to the accompanying drawings.

Embodiment 1

Figure 1:
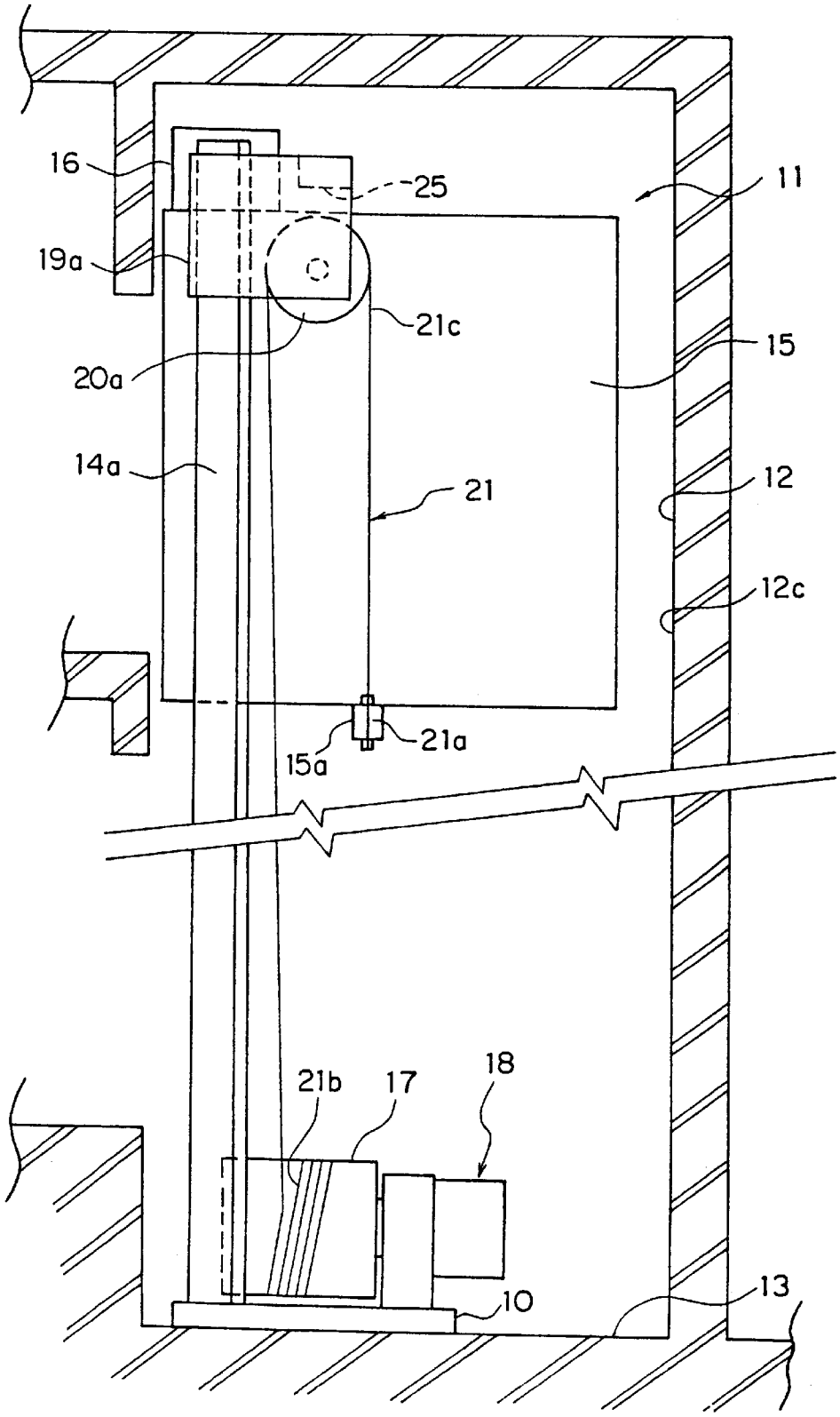
FIG. 1 is a side elevational view showing an elevator apparatus in accordance with a first embodiment of the present invention.
Figure 2:
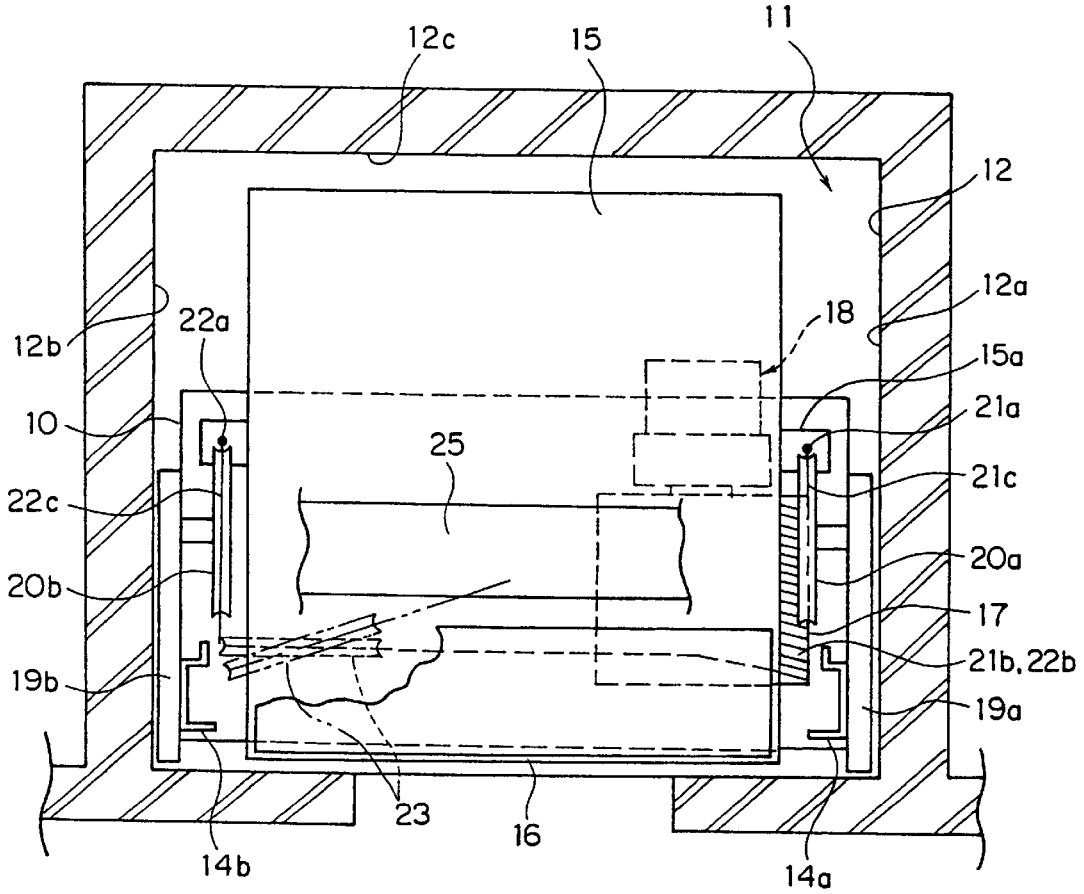
FIG. 2 is a plan view showing the apparatus shown in FIG.
Figure 3:
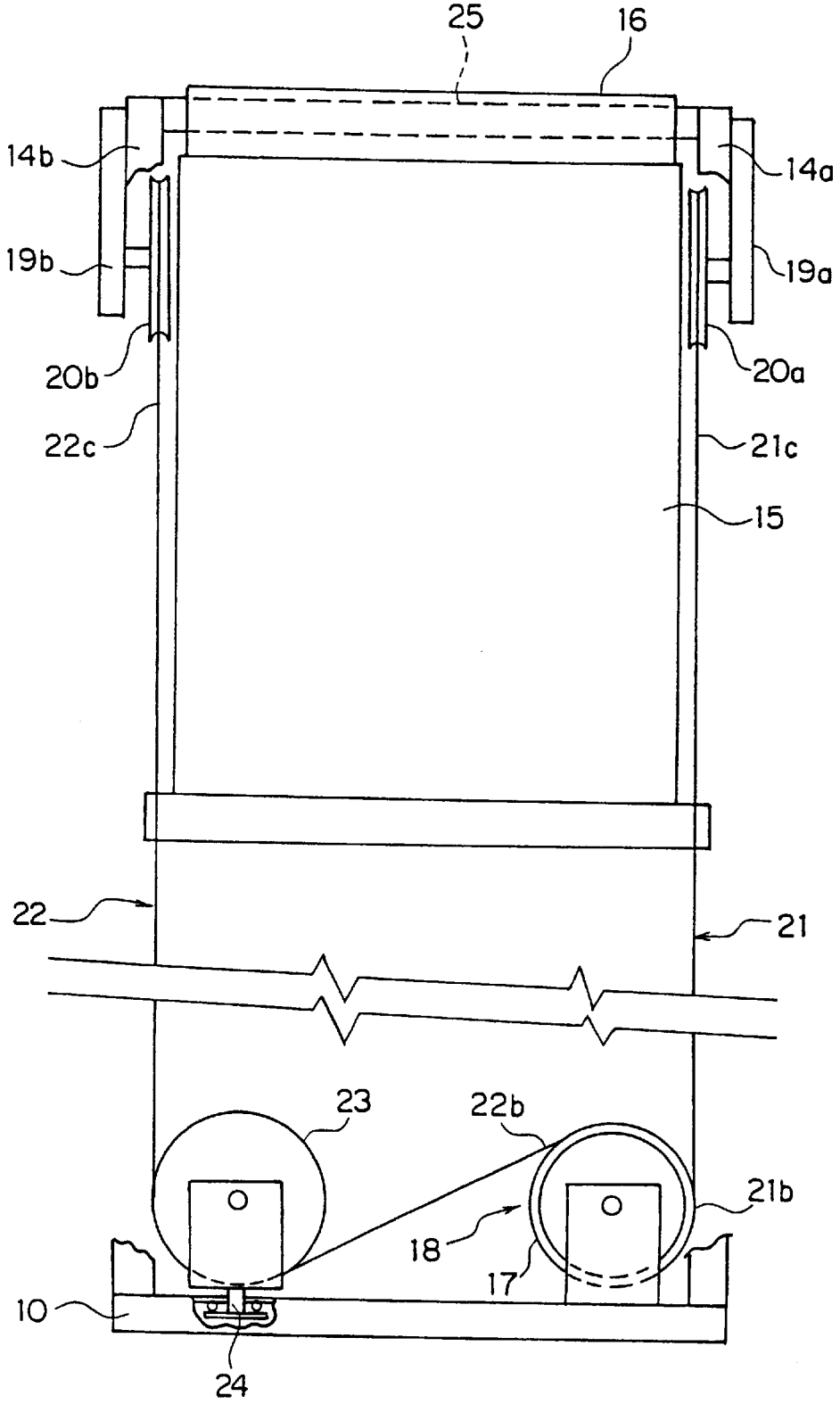
FIG. 3 is a frontal view showing the apparatus shown in FIG. 1.

FIG. 1 is a side elevational view showing an elevator apparatus in accordance with a first embodiment of the present invention, FIG. 2 is a plan view showing the apparatus shown in FIG. 1, and FIG. 3 is a frontal view showing the apparatus shown in FIG. 1. In these drawings, a hoistway 11 has a hoistway wall 12 and a bottom portion (pit) 13. The hoistway wall 12 has first and second side walls 12*a* and 12*b* facing each other and a third side wall (rear wall) 12*c* perpendicular to the side walls 12*a* and 12*b*.

A base 10 is provided on the bottom portion 13 of the hoistway 11. A pair of guide rails 14*a* and 14*b* are provided on the base 10. A car 15 which ascends and descends while being guided by the guide rails 14*a* and 14*b* is provided within the hoistway 11. A door device 16 for opening/closing doors (not shown) at the landing and doors for the car are provided in an upper portion of the car 15. The door device 16 projects upwardly from the upper portion of the car 15.

A hoisting machine 18 having a drum 17 is installed on the base 10. The hoisting machine 18 is shadowed by a car projection region which is the area covered by a projection from the car 15 in the hoistway direction and is installed in a location where a portion of the drum 17, i.e., the portion that feeds out the first and second ropes 21 and 22 is out from under the car projection region.

Return pulley mounting members 19*a* and 19*b* are fixed to upper portions of the guide rails 14*a* and 14*b*, respectively. These return pulley mounting members 19*a* and 19*b* are connected with each other through a joint member 25. When the car 15 is positioned at the uppermost position, the joint member 25 is arranged behind the door device 16.

First and second rotatable return pulleys 20*a* and 20*b* are supported at the pair of return pulley mounting members 19*a* and 19*b*. The first return pulley 20*a* is disposed between the car projection region and the first side wall 12*a* so that its rotary shaft is perpendicular to the first side wall 12*a*. The second return pulley 20*b* is disposed between the car projection region and the second side wall 12*b* so that its rotary shaft is perpendicular to the second side wall 12*b*.

Also, at least a portion of each of the first and second return pulleys 20*a* and 20*b* is located at a height between the hoistway wall 12 and the car 15 when the car 15 is located at the uppermost position.

The first and second ropes 21 and 22 as hoisting ropes are connected between the drum 17 and the car 15. These first and second ropes 21 and 22 have first end portions 21*a* and 22*a* fastened to a lower beam 15*a* of the car 15, second end portions 21*b* and 22*b* wound around the drum 17, and intermediate portions 21*c* and 22*c* wound around the first and second return pulleys 20*a* and 20*b* through a space between the car 15 and the hoistway wall 12.

The first and second return pulleys 20*a* and 20*b* are disposed so that the car 15 side of the first and second ropes 21 and 22 is closer to a center of gravity of the car 15 than the drum 17 side. In this case, the car 15 is suspended approximately at its center of gravity in the vertical direction by the ropes 21 and 22.

A deflector wheel 23 for introducing the second rope 22 between the second hoistway wall 12*b* and the car 15 is installed on the base 10. The deflector wheel 23 is rotatable about a shaft 24 that is perpendicular to its installation surface.

Next, the operation will be described. The drum 17 of the hoisting machine 18 is rotated so that the first and second ropes 21 and 22 are simultaneously fed out or wound up. As a result, the car 15 is raised or lowered within the hoistway 11 along the guide rails 14*a* and 14*b*. In this case, the deflector wheel 23 is rotated about the shaft 24 in correspondence with the change in winding position of the drum 17 of the second rope 22.

In such an elevator apparatus, the hoisting machine 18 is installed on the bottom portion 13 of the hoistway 11, and so that it is shadowed by the car projection region, except for the portions of the drum 17 that feed out the first and second ropes 21 and 22. Accordingly, it is unnecessary to separately provide a machine room. Also, it is possible to minimize the area of the hoistway 11. Thus, enhancing the utilization efficiency of the building.

Also, the two return pulleys 20*a* and 20*b* and the deflector wheel 23 are used so that the car 15 is suspended by the two ropes 21 and 22. Accordingly, the car may be stably raised and lowered at the same time, a load applied to the guide rails 14*a* and 14*b* may be reduced to thereby enhance the riding comfort.

Furthermore, the deflector wheel 23 is rotatable about the shaft 24. Accordingly, the entrance angle of the second rope 22 to the deflector wheel 23 is kept small, and friction between the second rope 22 and a groove of the deflector wheel 23 may be kept to a low level. At the same time, it is possible to prevent the car 15 from vibrating.

Moreover, since the space between the return pulley mounting members 19*a* and 19*b* fixed to the upper end portions of the guide rails 14*a* and 14*b* are connected to the joint member 25, it is possible to stably maintain the space between the pair of return pulleys 20*a* and 20*b*, and at the same time, prevent the guide rails 14*a* and 14*b* from vibrating. In addition, since the joint member 25 is disposed behind the uppermost position of the door device 16, it is possible to reduce the height of the hoistway 11 compared to the case where the guide rails 14*a* and 14*b* are connected higher than the uppermost position of the door device 16.

Also, since the first and second return pulleys 20*a* and 20*b* are disposed between the car projection region and the side walls 12*a* and 12*b* so that their rotary shafts are perpendicular to the side walls 12*a* and 12*b*, it is possible to reduce the area of the hoistway 11.

Furthermore, since the first and second return pulleys 20*a* and 20*b* are disposed at a height located between the hoistway walls 12 and the car 15 when the car 15 is located at the uppermost position, it is possible to save space in the upper portion of the hoistway 11 and to reduce the height of the hoistway 11.

Moreover, since the first and second return pulleys 20*a* and 20*b* are arranged so that the portions of the first and second ropes 21 and 22 on the car 15 side are located closer to the center of gravity of the car 15 than the portions thereof on the drum 17 side, the load applied to the guide rails 14*a* and 14*b* is reduced, and the car 15 can thereby be stably raised and lowered.

Embodiment 2

Figure 4:
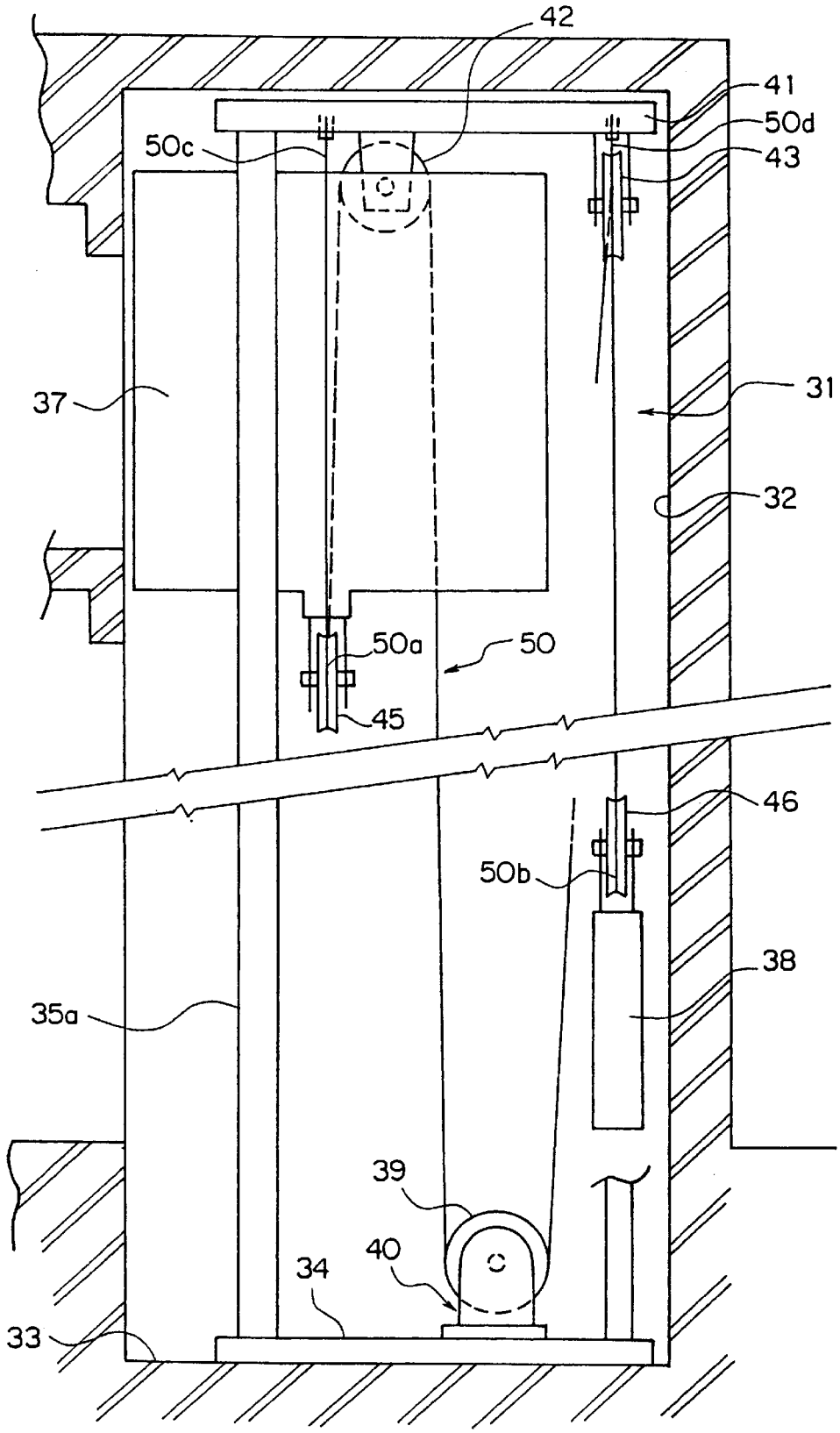
FIG. 4 is a side elevational view showing an elevator apparatus in accordance with a second embodiment of the present invention.
Figure 5:
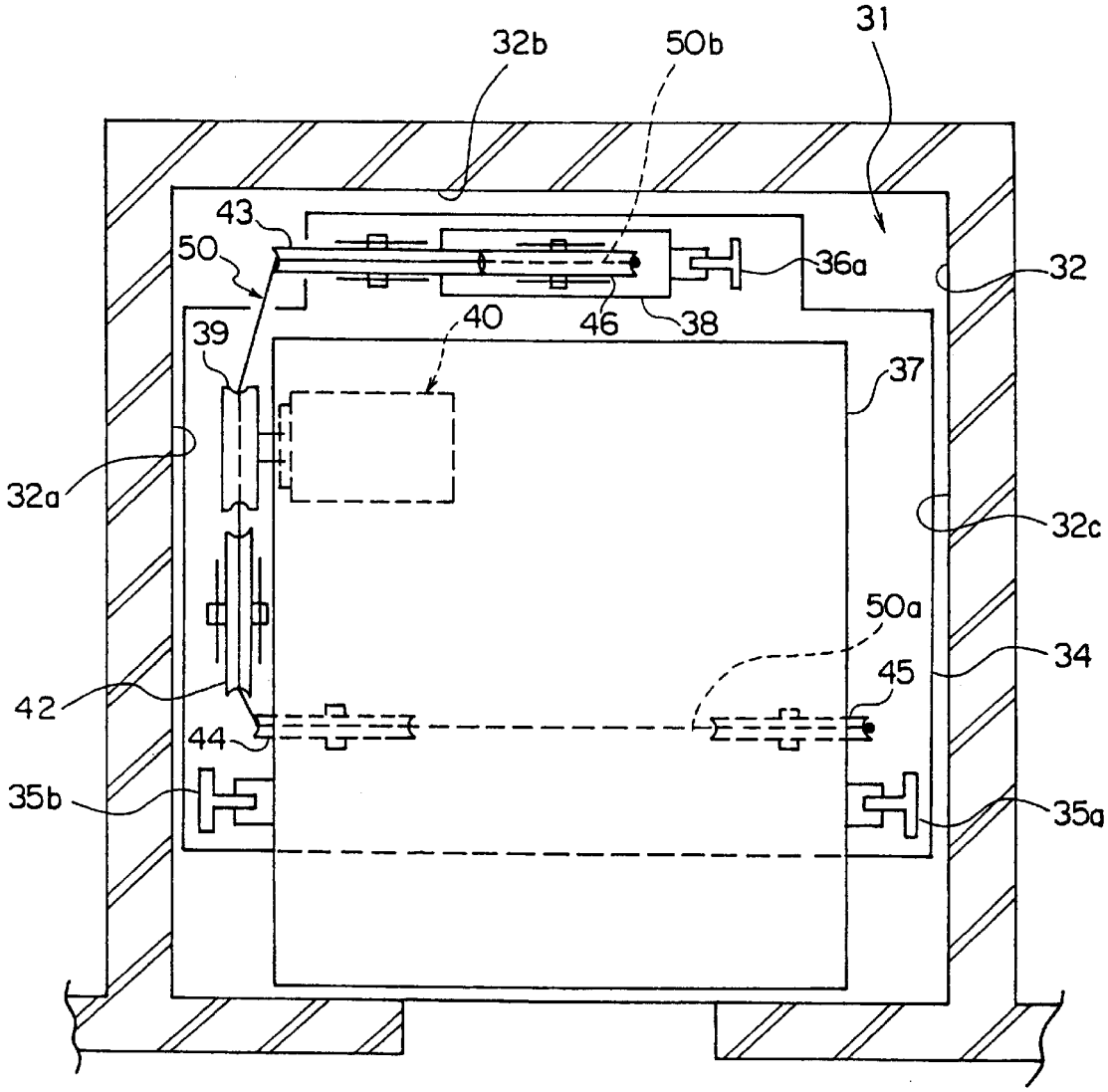
FIG. 5 is a plan view showing the apparatus shown in FIG. 4.
Figure 6:
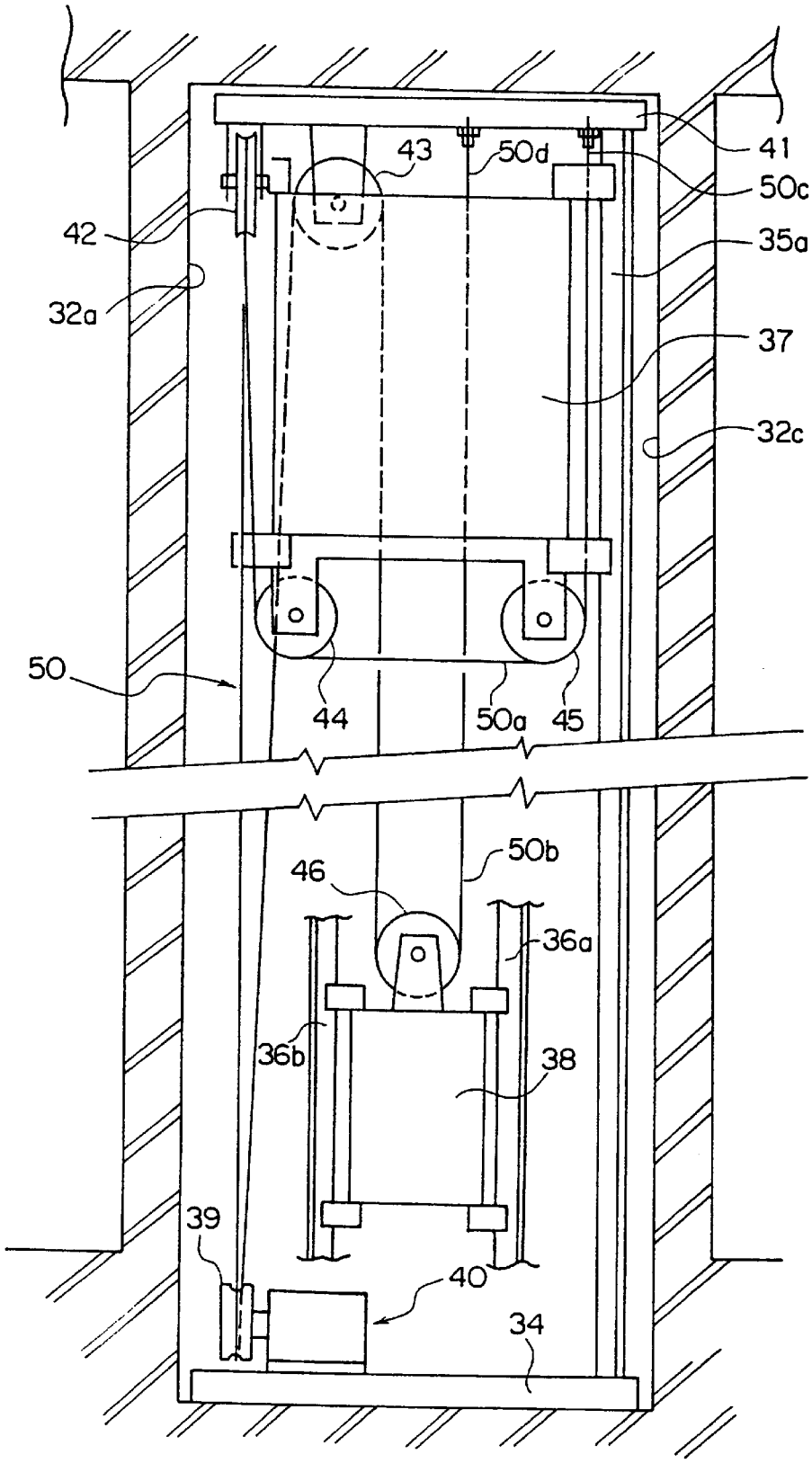
FIG. 6 is a frontal view showing the apparatus shown in FIG. 4.

FIG. 4 is a side elevational view showing an elevator apparatus in accordance with a second embodiment of the present invention, FIG. 5 is a plan view showing the apparatus shown in FIG. 4, and FIG. 6 is a frontal view showing the apparatus shown in FIG. 4. In these drawings, a hoistway 31 has a hoistway wall 32 and a bottom portion (pit) 33. The hoistway wall 32 has first and second side walls 32*a* and 32*b* perpendicular to each other and a third side wall 32*c* facing the first side wall 32*a*.

A base 34 is provided on the bottom portion 33 of the hoistway 31. A pair of car guide rails 35*a* and 35*b* and a pair of weight guide rails 36*a* and 36*b* are provided on the base 34. A car 37 that ascends and descends while being guided by the car guide rails 35*a* and 35*b* is provided within the hoistway 31. A balance weight 38 which ascends and descends while being guided by the weight guide rails 36*a* and 36*b* is disposed on the rear side (right side in FIG. 4) of the car 37.

A hoisting machine 40 having a traction sheave 39 is provided on the base 34. The hoisting machine 40 is shadowed by a car projection region obtained by a projection from the car 37 in the hoistway direction, and the traction sheave 39 is located at a position away from the car projection region.

A support frame 41 is fixed to upper end portions of the car guide rails 35*a* and 35*b* and the weight guide rails 36*a* and 36*b*. The first and second return pulleys 42 and 43 are supported at the support frame 41. The first return pulley 42 is disposed between the car projection region and the first side wall 12*a* so that its rotary shaft is perpendicular to the first side wall 32*a*. The second return pulley 43 is disposed between the car projection region and the second side wall 32*b* so that its rotary shaft is perpendicular to the second side wall (rear wall) 32*b*.

Also, the first and second return pulleys 42 and 43 are arranged so that at least a portion thereof is located at a height between the hoistway wall 32 and the car 37 when the car 37 is located at the uppermost position.

First and second car suspension pulleys 44 and 45 are arranged at an interval from each other at a lower portion of the car 37. A weight suspension pulley 46 is provided on an upper portion of the balance weight 38.

The car 37 and the balance weight 38 are suspended within the hoistway 31 by a rope 50. The rope 50 has a car suspension portion 50*a* wound around the first return pulley 42 for suspending the car 37 and a weight suspension portion 50*b* wound around the second return pulley 43 for suspending the balance weight 38.

Figure 7:
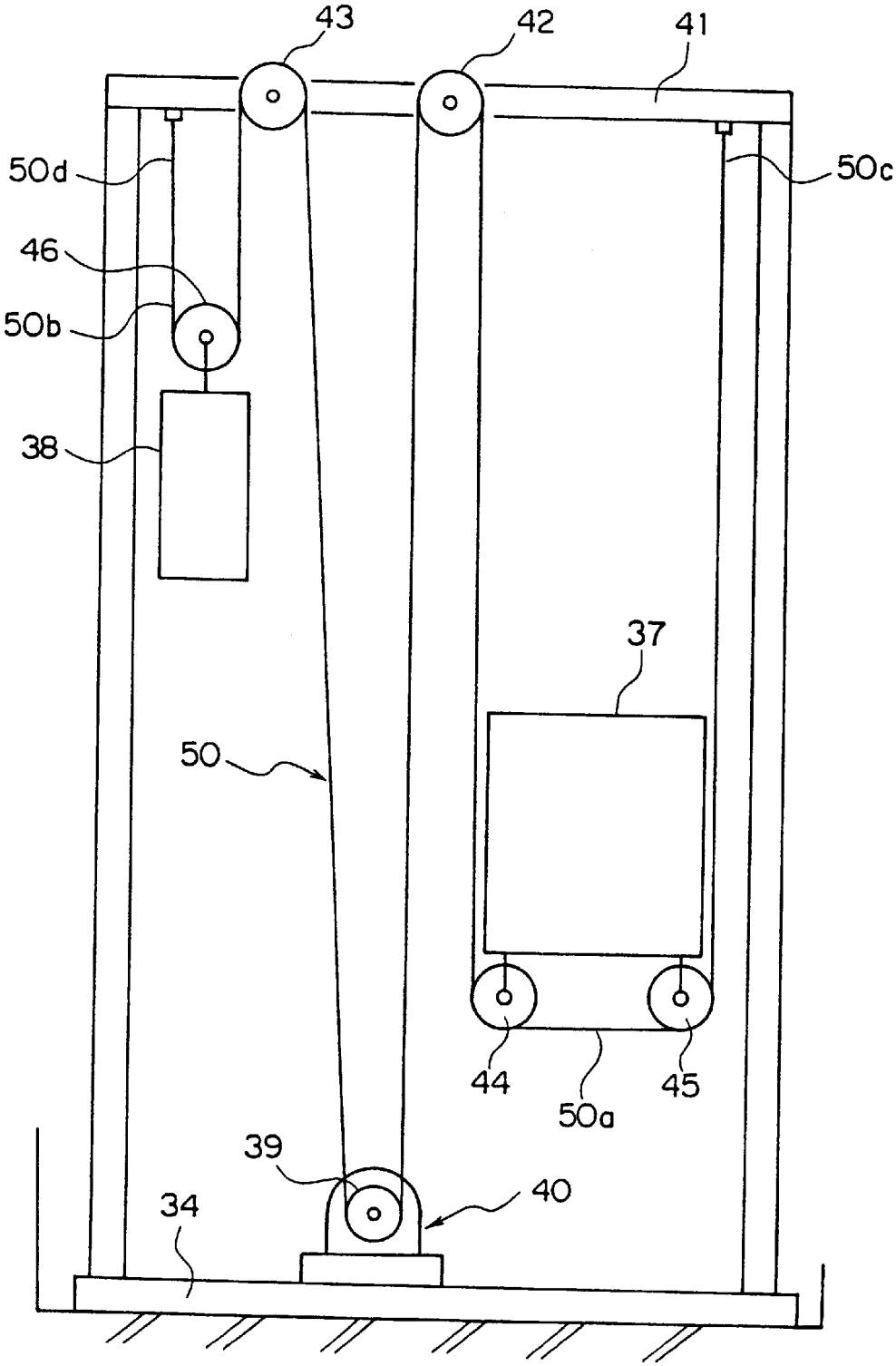
FIG. 7 is an explanatory view showing the path of the rope of the apparatus shown in FIG. 4.
Figure 8:
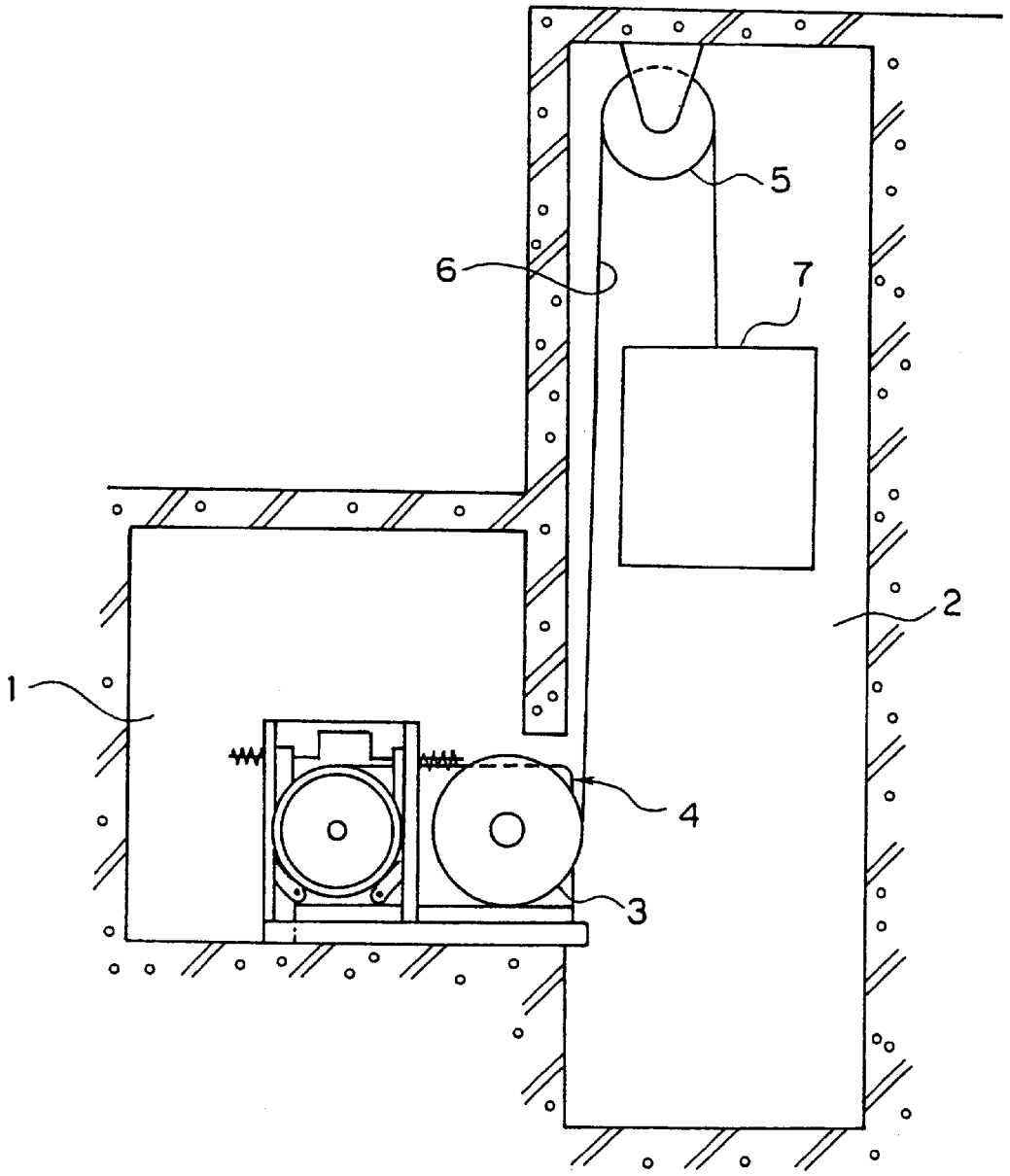
FIG. 8 PRIOR ART
FIG. 8 is a structural view showing an example of a conventional elevator apparatus.
Figure 9:
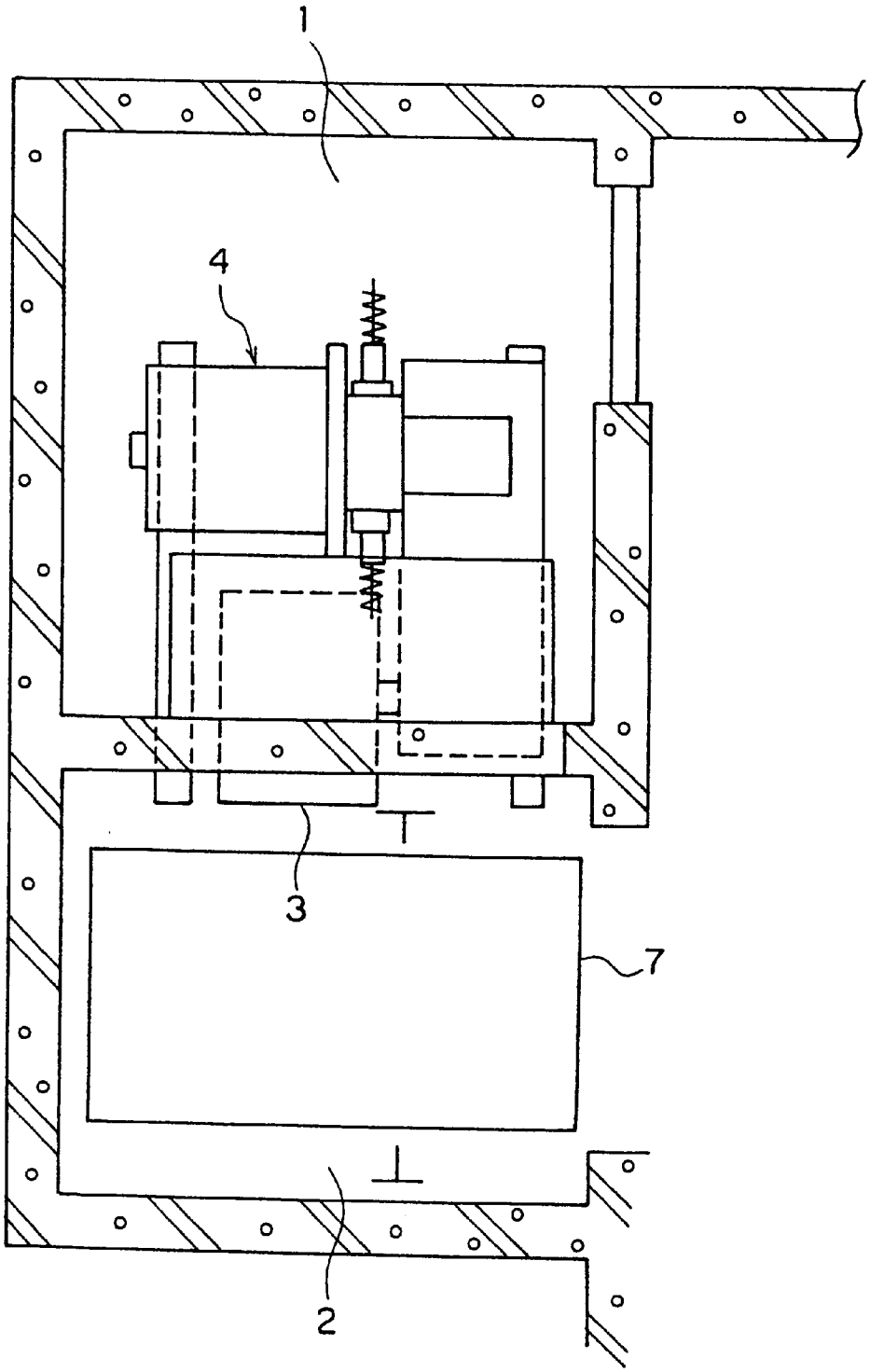
FIG. 9 PRIOR ART
FIG. 9 is a plan view of FIG. 8.

The portion between the car suspension portion 50*a* and the weight suspension portion 50*b* of the rope 50 is wound around the traction sheave 39. The end portions 50*c* and 50*d* of the rope 50 on the car suspension portion 50*a* side and the weight suspension portion 50*b* side are fixed to the support frame 41, respectively. Further, FIG. 7 is an explanatory view showing a path of the rope 50 of the apparatus shown in FIG. 4.

The first return pulley 42 is arranged so that the car suspension portion 50*a* of the rope.50 on the car 37 side is located closer to the center of gravity of the car 37 than the portion on the traction sheave 39 side. In this case, the car suspension pulleys 44 and 45 are arranged substantially at the center of gravity in the vertical direction of the car 37.

Next, the operation will be described. The traction sheave 39 of the hoisting machine 40 is rotated to thereby feed the rope 50 from the-car suspension portion 50*a* to the weight suspension portion 50*b* or feed the rope 50 from the weight suspension portion 50*b* to the car suspension portion 50*a*, thus alternately raising and lowering the car 37 and the balance weight 38 within the hoistway 11.

In such an elevator apparatus, the hoisting machine 40 is disposed on the bottom portion 33 of the hoistway 31, and so that it is shadowed by the car projection region except for the traction sheave 39. Accordingly, it is unnecessary to separately provide a machine room, and it is possible to minimize the area of the hoistway 31 and thereby enhance the building utilization efficiency.

Also, since the car 37 is suspended at both sides thereof by using the first and second suspension pulleys 44 and 45, it is possible to raise and lower the car 37 in a stable manner, and also to reduce the load applied to the car guide rails 35*a* and 35*b* improve the riding comfort.

Furthermore, since the first and second return pulleys 42 and 43 are disposed between the car projection region and the side walls 32*a* and 32*b* so that their rotary shafts are perpendicular to the side walls 32*a* and 32*b*, it is possible to reduce the area of the hoistway 31.

Furthermore, since the first and second return pulleys 42 and 43 are disposed at a height located between the hoistway walls 32 and the car 37 when the car 37 is located at the uppermost position, it is possible to save space in the upper portion of the hoistway 31 and to reduce the height of the hoistway 31.

Moreover, since the first return pulley 42 is arranged so that the portion on the car 37 side of the rope 50 is located closer to the center of gravity of the car 37 than the portion thereof on the traction sheave 39 side, the load applied to the guide rails 35*a* and 35*b* is reduced to thereby stably raise and lower the car 37.

Incidentally, in the apparatus in accordance with the second embodiment, the pair of car guide rails 35*a* and 35*b* may be coupled with each other by joint members. In this case, the joint members may be disposed on the rear side of the uppermost position of a door device (not shown) projecting from the car 37.

Also, in the case where the hoisting machines 18 and 40 are located on the bottom portions 13 and 33 of the hoistways 11 and 31 as shown in the first and second embodiments, the hoisting machines may be reduced in size by using a planetary gear assembly or rollers. In this case, it is possible to expand the space for maintenance work.

What is claimed is:

1. An elevator apparatus comprising:

a hoistway having hoistway walls and a bottom portion;

a car which ascends and descends within said hoistway;

a hoisting machine having a rotatable drum, said hoisting machine being disposed on the bottom portion of said hoistway so that said hoisting machine, except for a portion of said rotatable drum, is entirely within a car projection region obtained by projecting said car along said hoistway, the portion of said rotatable drum being outside the car projection region;

first and second return pulleys disposed within said hoistway;

first and second hoisting ropes having respective first ends connected to said car, respective second ends wound around said drum, and intermediate portions wound around said first and second return pulleys and passing through a space between said car and said hoistway walls, wherein said hoistway includes first and second side walls facing each other, said first and second return pulleys are respectively disposed between the car projection region and said first and second side walls, respectively, and the portion of said drum outside the car projection region feeds out and in the first hoisting rope; and a deflector wheel being disposed on the bottom portion of said hoistway for directing said second rope between said second hoistway wall and said car.

2. The elevator apparatus according to claim 1, wherein said hoistway wall has first and second side walls facing each other, said return pulley has a first return pulley disposed between said car projection region and said first side wall and a second return pulley disposed between said car projection region and said second side wall, said hoisting rope has first and second ropes wound around said first and second return pulleys, respectively, with a deflector wheel being disposed on a bottom portion of said hoistway for introducing said second rope between said second hoistway wall and said car.

3. The elevator apparatus according to claim 1, wherein said deflector wheel is mounted on the bottom portion of said hoistway and is rotatable about a shaft parallel to said hoistway walls.

4. The elevator apparatus according to claim 2, further comprising:

a pair of guide rails disposed within said hoistway for guiding ascending and descending movement of said car;

a pair of return pulley mounting members mounted on said pair of guide rails, respectively, for supporting said first and second return pulleys;

a door device mounted on said car and projecting upwardly from an upper portion of said car; and joint members disposed behind an uppermost position of said door device connecting said pair of return pulley mounting members to each other.

5. The elevator apparatus according to claim 1, wherein said first and second return pulleys are disposed within said hoistway and including rotary shafts perpendicular to said hoistway walls.

6. The elevator apparatus according to claim 1 wherein said first and second return pulleys are disposed within said hoistway so that at least a portion of said first and second return pulleys are located between said hoistway walls and said car when said car is located at an uppermost position.

7. The elevator apparatus according to claim 1, wherein said first and second return pulleys are disposed so that portions of said first and second hoisting ropes at sides of said car are located closer to a center of gravity of said car than are portions of said first and second hoistway ropes on said drum.

8. An elevator apparatus comprising:

a hoistway having hoistway walls and a bottom portion;

a car and a balance weight for alternately ascending and descending within said hoistway;

a hoisting machine having a rotatable traction sheave, said hoisting machine being disposed on the bottom portion of said hoistway so that said hoisting machine is within a car projection region obtained by projection of said car along said hoistway, said traction sheave being outside the car projection region;

first and second rotatable return pulleys disposed within said hoistway; and a rope having a car suspension portion wound around said first return pulley for suspending said car, a weight suspension portion wound around said second return pulley for suspending said balance weight, and an intermediate portion wound around said traction sheave between said car suspension portion and said weight suspension portion.

9. The elevator apparatus according to claim 8, including first and second car suspension pulleys around which said car suspension portion is mounted, spaced from each other at a lower portion of said car, wherein an end of said rope adjacent said car suspension portion is fixedly mounted within said hoistway.

10. The elevator apparatus according to claim 8, wherein said hoistway walls include first and second side walls perpendicular to each other, said first return pulley is disposed above traction sheave and has a rotary shaft perpendicular to said first side wall, and said second return pulley has a rotary shaft perpendicular to said second side wall.

11. The elevator apparatus according to claim 8, wherein said first and second return pulleys are disposed within said hoistway so that at least portions of each of said first and second return pulleys are located between said hoistway walls and said car when said car is located at an uppermost position.

12. The elevator apparatus according to claim 8, wherein said first return pulley is disposed so that a portion of said rope at a side of said car is located closer to a center of gravity of said car than a portion of said rope on said hoisting machine.

13. The elevator apparatus according to claim 8, further comprising:

a pair of guide rails disposed within said hoistway for guiding ascending and descending of said car;

a door device mounted on said car and projecting upwardly from an upper portion of said car; and joint members, disposed behind an uppermost position of said door device, connecting said pair of guide rails to each other.

14. An elevator apparatus comprising:

a hoistway having hoistway walls and a bottom portion;

a car and a balance weight for alternately ascending and descending within said hoistway;

a hoisting machine having a rotatable traction sheave, said hoisting machine being disposed on the bottom portion of said hoistway so that said hoisting machine is within a car projection region obtained by projecting said car along said hoistway, said traction sheave being outside the car projection region;

first and second rotatable return pulleys disposed within said hoistway, said first and second return pulleys being disposed within said hoistway so that at least portions of each of said first and second return pulleys are located between said hoistway walls and said car when said car is located at an uppermost position; and a rope having a car suspension portion wound around said first return pulley for suspending said car, a weight suspension portion wound around said second return pulley for suspending said balance weight, and an intermediate portion wound around said traction sheave between said car suspension portion and said weight suspension portion.

15. The elevator apparatus according to claim 14, including first and second car suspension pulleys around which said car suspension portion is mounted, spaced from each other at a lower portion of said car, wherein an end of said rope adjacent said car suspension portion is fixedly mounted within said hoistway.

16. The elevator apparatus according to claim 14, wherein said hoistway walls include first and second side walls perpendicular to each other, said first return pulley is disposed above traction sheave and has a rotary shaft perpendicular to said first side wall, and said second return pulley has a rotary shaft perpendicular to said second side wall.

17. The elevator apparatus according to claim 14, wherein said first return pulley is disposed so that a portion of said rope at a side of said car is located closer to a center of gravity of said car than a portion of said rope on said hoisting machine.

18. The elevator apparatus according to claim 14, further comprising:

a pair of guide rails disposed within said hoistway for guiding ascending and descending of said car;

a door device mounted on said car and projecting upwardly from an upper portion of said car; and joint members, disposed behind an uppermost position of said door device, connecting said pair of guide rails to each other.

* * * * *